US011371225B2

(12) United States Patent
Lin et al.

(10) Patent No.: US 11,371,225 B2
(45) Date of Patent: Jun. 28, 2022

(54) SHOWER HEAD HOLDER STRUCTURE

(71) Applicant: FUJIAN XIHE SANITARY WARE TECHNOLOGY CO., LTD., Fujian (CN)

(72) Inventors: Xiaofa Lin, Fujian (CN); Xiaoshan Lin, Fujian (CN); Qiqiao Liu, Fujian (CN); Xiaoqing Deng, Fujian (CN); Zhiwei Chen, Fujian (CN)

(73) Assignee: FUJIAN XIHE SANITARY WARE TECHNOLOGY CO., LTD., Fujian (CN)

( * ) Notice: Subject to any disclaimer, the term of this patent is extended or adjusted under 35 U.S.C. 154(b) by 435 days.

(21) Appl. No.: 16/726,860

(22) Filed: Dec. 25, 2019

(65) Prior Publication Data

US 2021/0040715 A1 Feb. 11, 2021

(30) Foreign Application Priority Data

Aug. 7, 2019 (CN) ..... 201921273526.1

(51) Int. Cl.
*E03C 1/06* (2006.01)
*B05B 1/18* (2006.01)

(52) U.S. Cl.
CPC ..... *E03C 1/066* (2013.01); *B05B 1/185* (2013.01)

(58) Field of Classification Search
CPC . E03C 1/06; E03C 1/063; E03C 1/066; B05B 1/18; B05B 1/185; F16B 2/04; F16B 2/06; F16B 2/12; F16B 2/18; Y10T 403/59; Y10T 403/591; Y10T 403/593; Y10T 403/595; Y10T 403/598; Y10T 403/599; Y10T 403/60; Y10T 403/602; Y10T 403/604; B25G 3/00; B25G 3/02; B25G 3/04; B25G 3/06; B25G 3/08; B25G 3/10; B25G 3/12; B25G 3/14; B25G 3/18; B25G 3/24
USPC ..... 16/422, 425, 426, 427; 248/309.1
See application file for complete search history.

(56) References Cited

U.S. PATENT DOCUMENTS

2009/0007330 A1* 1/2009 Genord ..... B05B 1/18 4/695
2016/0236223 A1* 8/2016 Scheffer ..... E03C 1/06
2017/0014849 A1* 1/2017 Gao ..... B05B 15/62
2018/0313070 A1* 11/2018 Zhang ..... E03C 1/06
2018/0339300 A1* 11/2018 Lin ..... B05B 15/65
2019/0299224 A1* 10/2019 Wu ..... B05B 1/16
2020/0360955 A1* 11/2020 Huang ..... B05B 15/68

* cited by examiner

*Primary Examiner* — Tuongminh N Pham
*Assistant Examiner* — Juan C Barrera
(74) *Attorney, Agent, or Firm* — JCIPRNET

(57) ABSTRACT

The disclosure discloses a shower head holder structure, which includes a shower head and a holder, the shower head has a lever and a pair of blocks; when the first end of the lever is pressed, the second end of the lever on the back of the nozzle is lifted, and the two blocks on both sides of the second end are brought closer to each other; when the first end of the lever is released, the two blocks are away from each other; the holder is provided with a pair of slots matched with the pair of blocks; when the blocks are inserted into the pair of slots, the shower head is hung up on the holder.

10 Claims, 8 Drawing Sheets

SHOWER HEAD HOLDER STRUCTURE

CROSS REFERENCE TO RELATED APPLICATION

This application claims the priority benefits of China application serial no. 201921273526.1, filed on Aug. 7, 2019. The entirety of the above-mentioned patent application is hereby incorporated by reference herein and made a part of specification.

BACKGROUND

Technical Field

The present disclosure relates to the field of sanitary ware, and particularly relates to shower head holder structure.

Description of Related Art

The existing handheld shower heads are mostly fixed by inserting a hose structure of the shower head into a separate fixing bracket, but the fixing method requires the user to lift the handle up to remove the shower head, and the hose connector needs to be aligned with the insertion hole of the bracket in order to secure the shower head. The above design is not user-friendly and causes inconvenience for the elderly and children to operate. Currently, a bracket for holding the handheld shower head that can be disposed on a two-way or one-way water inlet bracket has been developed and available in the North American market, but the above design still adopts the same way for fixing the shower head as described above. Therefore, there is still a problem that the design is not user-friendly, not easy for user to pick up and place the shower head, and the user experience is not good. Therefore, improvement should be made.

SUMMARY

The following is a summary of the subject matter of the disclosure, and the summary is not intended to limit the scope of the claims.

The embodiment of the present disclosure provides a shower head holder structure, which allows the user to easily fix or separate the shower head to or from the holder when the shower head handle is held by the user's hand, and it is not required for the user to move the shower head upward or downward when picking it up so that the operation is more convenient and improves user experience.

The embodiment of the present disclosure relates to a shower head holder structure, including:

A shower head having a lever, a first elastic member, a pair of blocks and a pair of second elastic members; wherein a fulcrum of the lever is disposed on a back surface of the shower head, and the first end of the lever extends to the shower head handle for pressing, the second end of the lever extends to the back of the nozzle of the shower head; the first elastic member is disposed between the first end of the lever and the fulcrum; the pair of the blocks are respectively disposed on both sides of the second end of the lever; the second elastic member is arranged corresponding to the blocks; when the first end of the lever is pressed, the first elastic member is compressed, the second end is lifted, and the second elastic member releases the elastic force to bring the two blocks closer together; when the first end of the lever is released, the first elastic member is reset, and the second end is driven to move downwards, so that the two blocks are away from each other and compress the second elastic member;

A holder having a pair of slots matched with the pair of blocks; when the blocks extend into the slots, the shower head is hung on the holder.

BRIEF DESCRIPTION OF THE DRAWINGS

In order to more clearly illustrate the technical solutions in the embodiments of the present disclosure, the drawings used in the description of the embodiments will be briefly described below. Obviously, the drawings described in the following description are some embodiments of the present application, those skilled in the art can derive other drawings based on these drawings without any inventive effort.

DESCRIPTION OF THE EMBODIMENTS

The technical solutions in the embodiments of the present disclosure are described below with reference to the accompanying drawings in the embodiments of the present disclosure.

Figure 1:
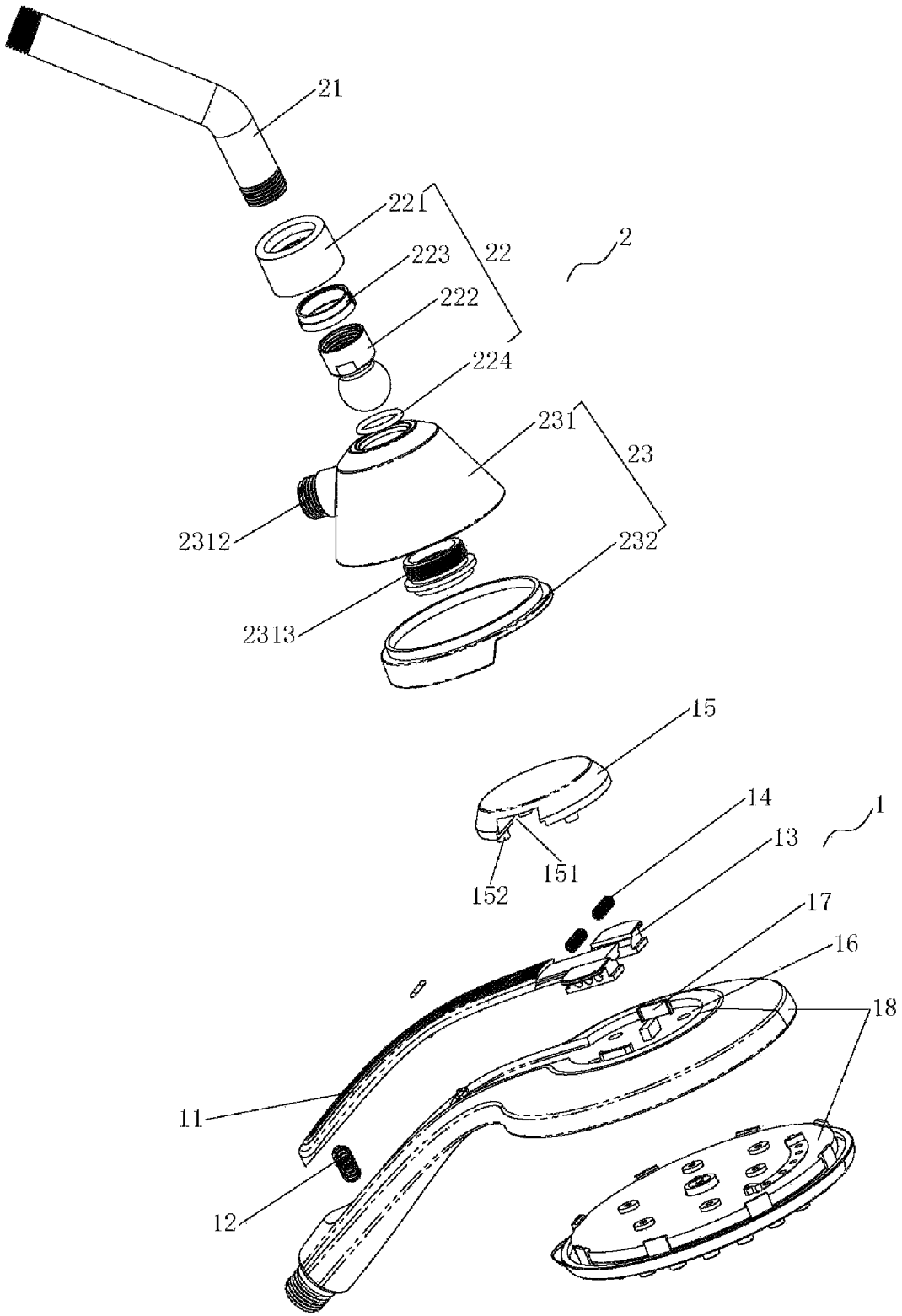
FIG. 1 is an exploded perspective view of the structure of the shower head holder structure in the embodiment of the present disclosure.
Figure 2:
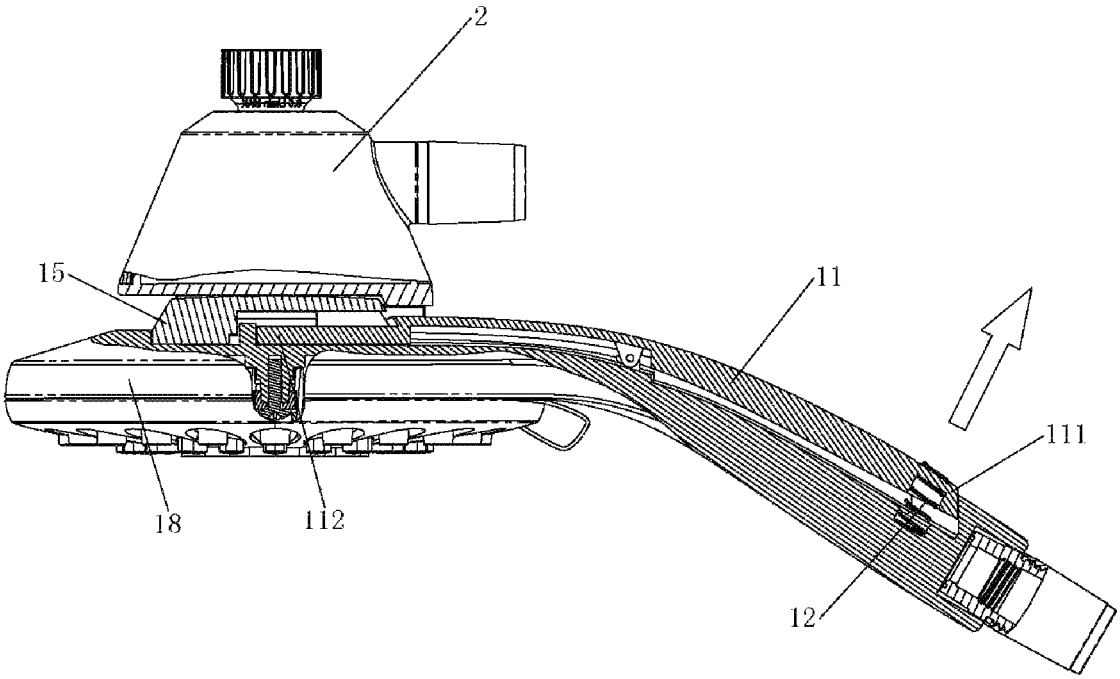
FIG. 2 is a first schematic structural view showing the state that the lever is not pressed in the embodiment of the present disclosure.
Figure 3:
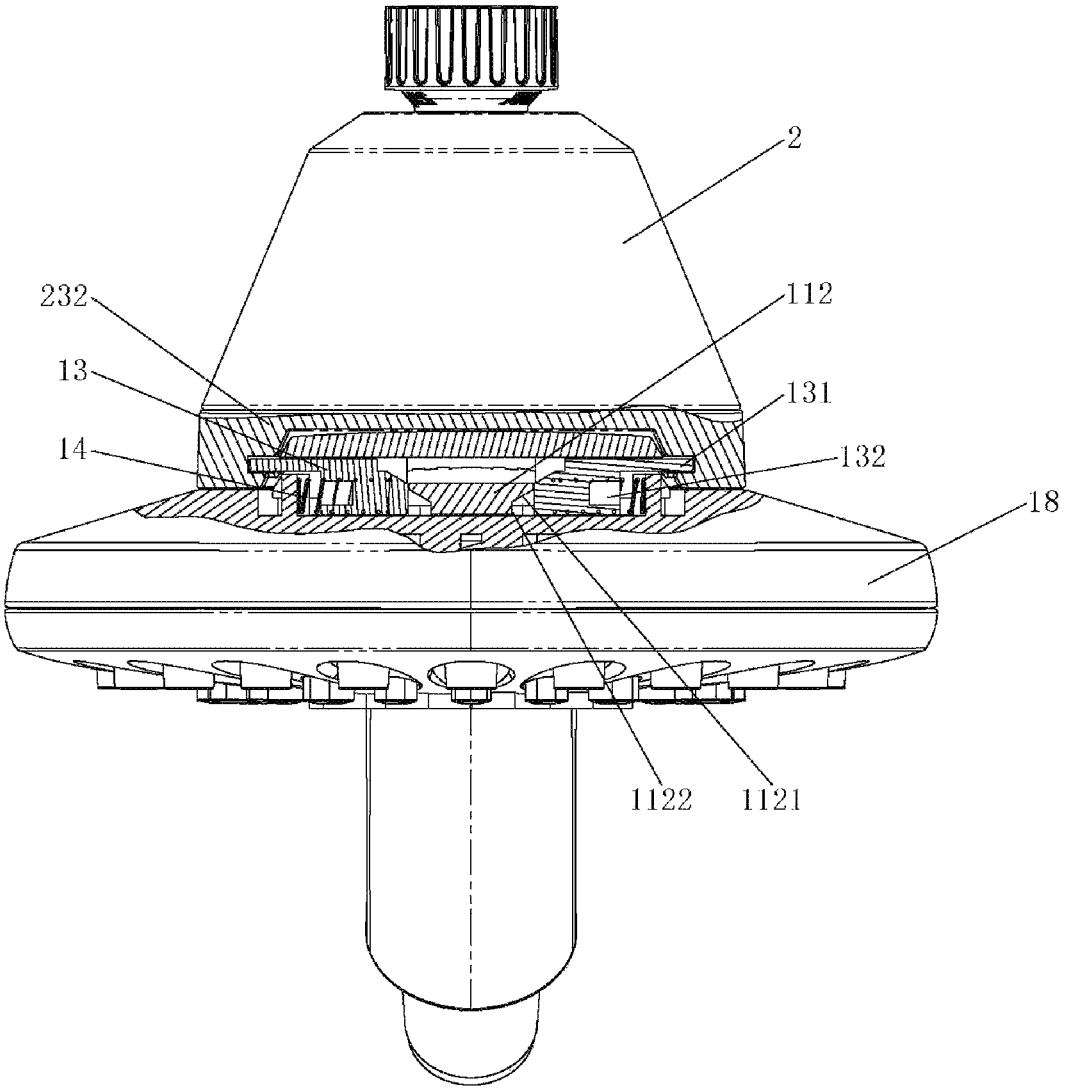
FIG. 3 is a second schematic structural view showing the state that the lever is not pressed in the embodiment of the present disclosure.
Figure 4:
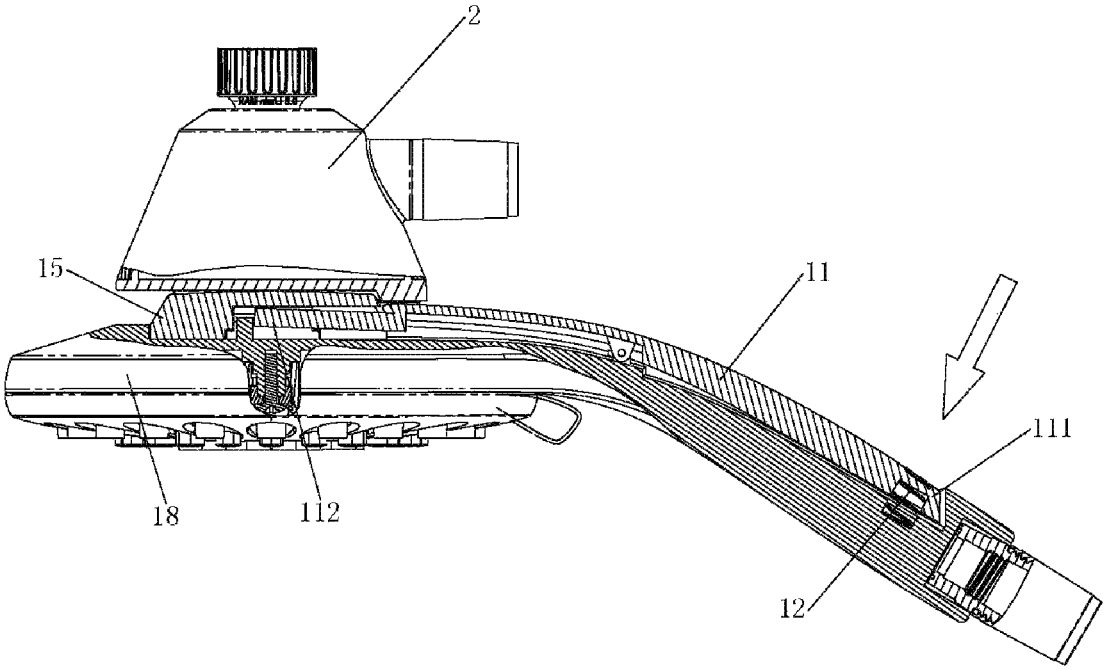
FIG. 4 is a first schematic structural view showing the state that the lever is pressed in the embodiment of the present disclosure.
Figure 5:
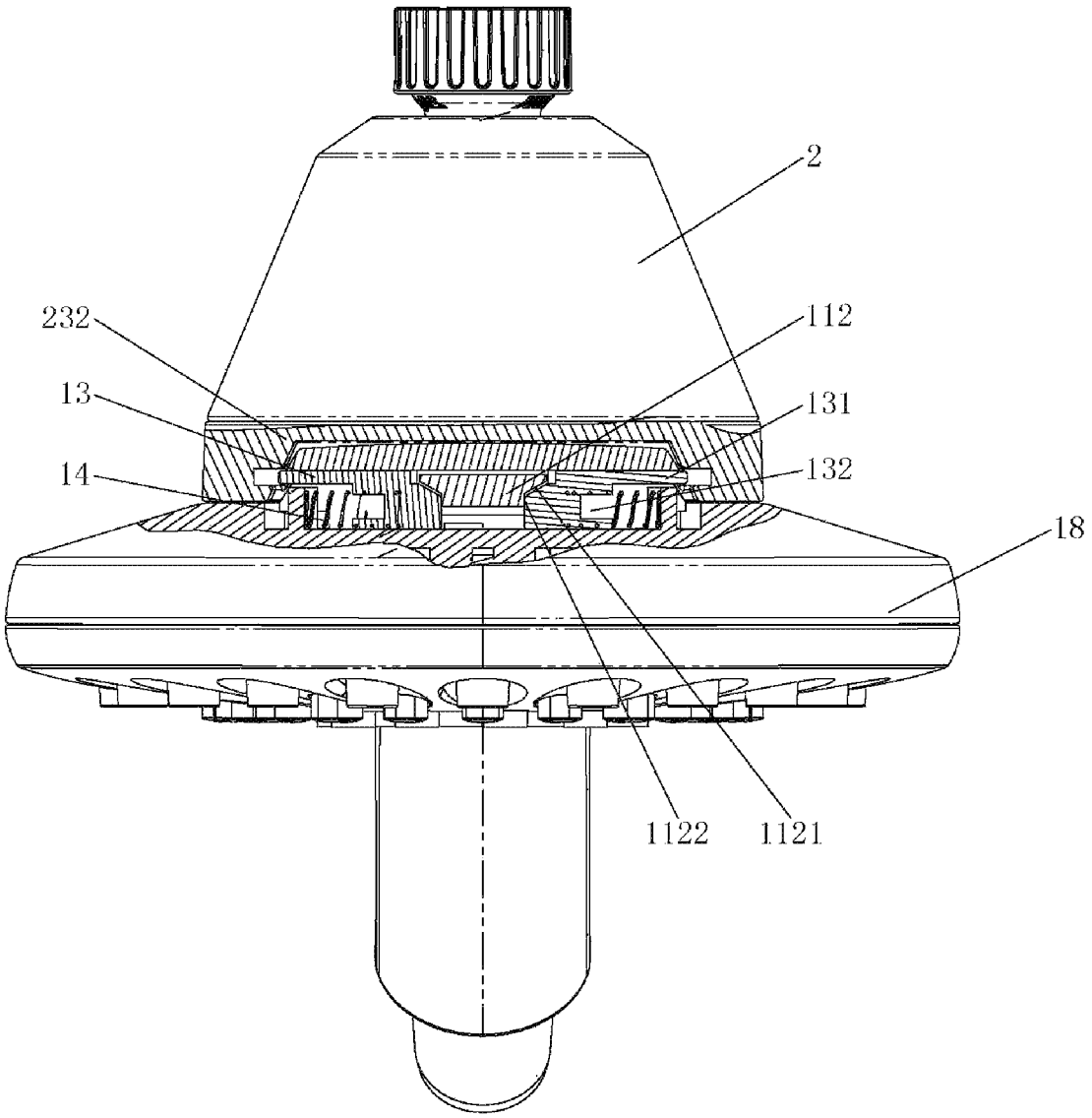
FIG. 5 is a second schematic structural view showing the state that the lever is pressed in the embodiment of the present disclosure.
Figure 6:
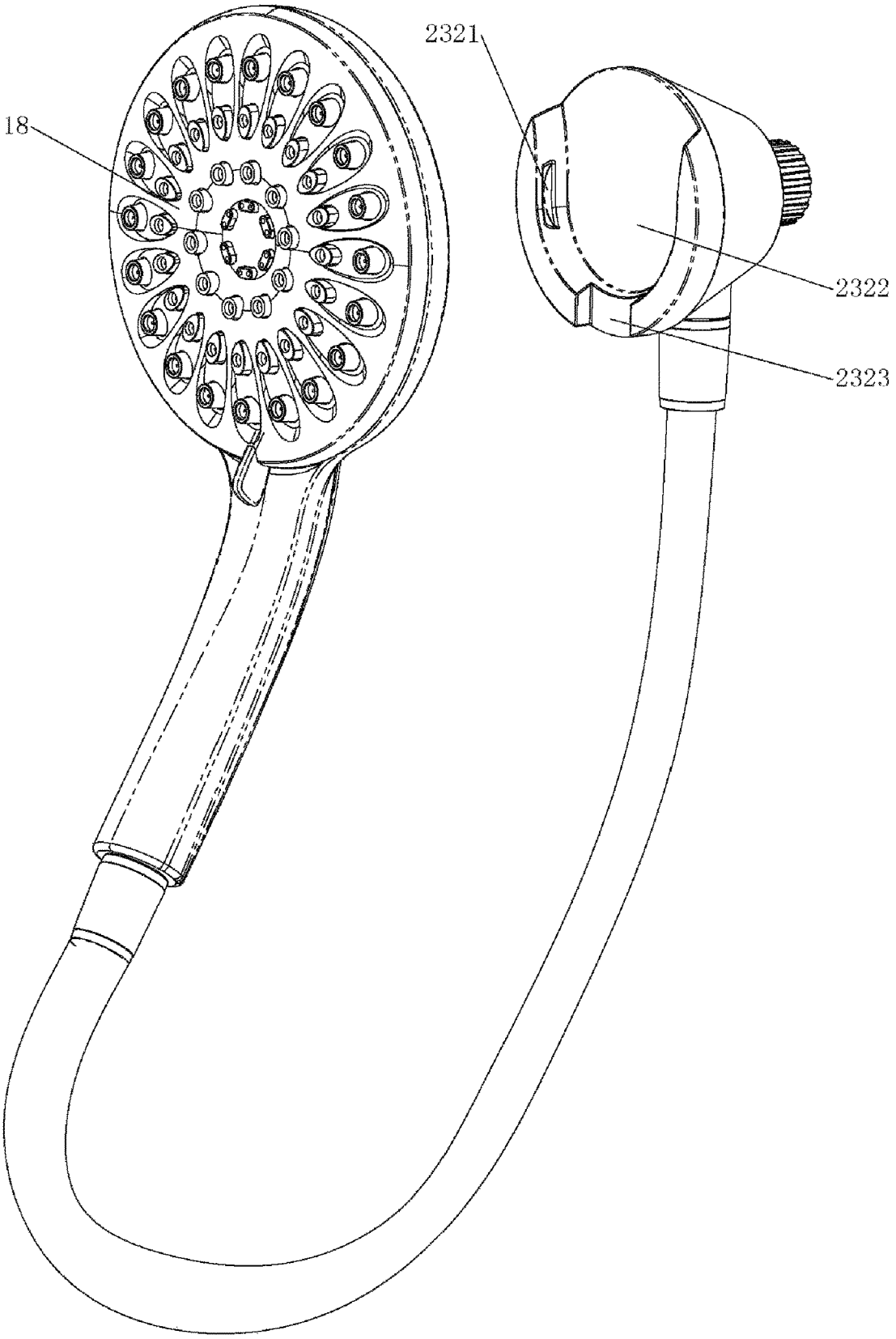
FIG. 6 is a first schematic perspective view of the structure of the shower head holder structure in an embodiment of the present disclosure.
Figure 7:
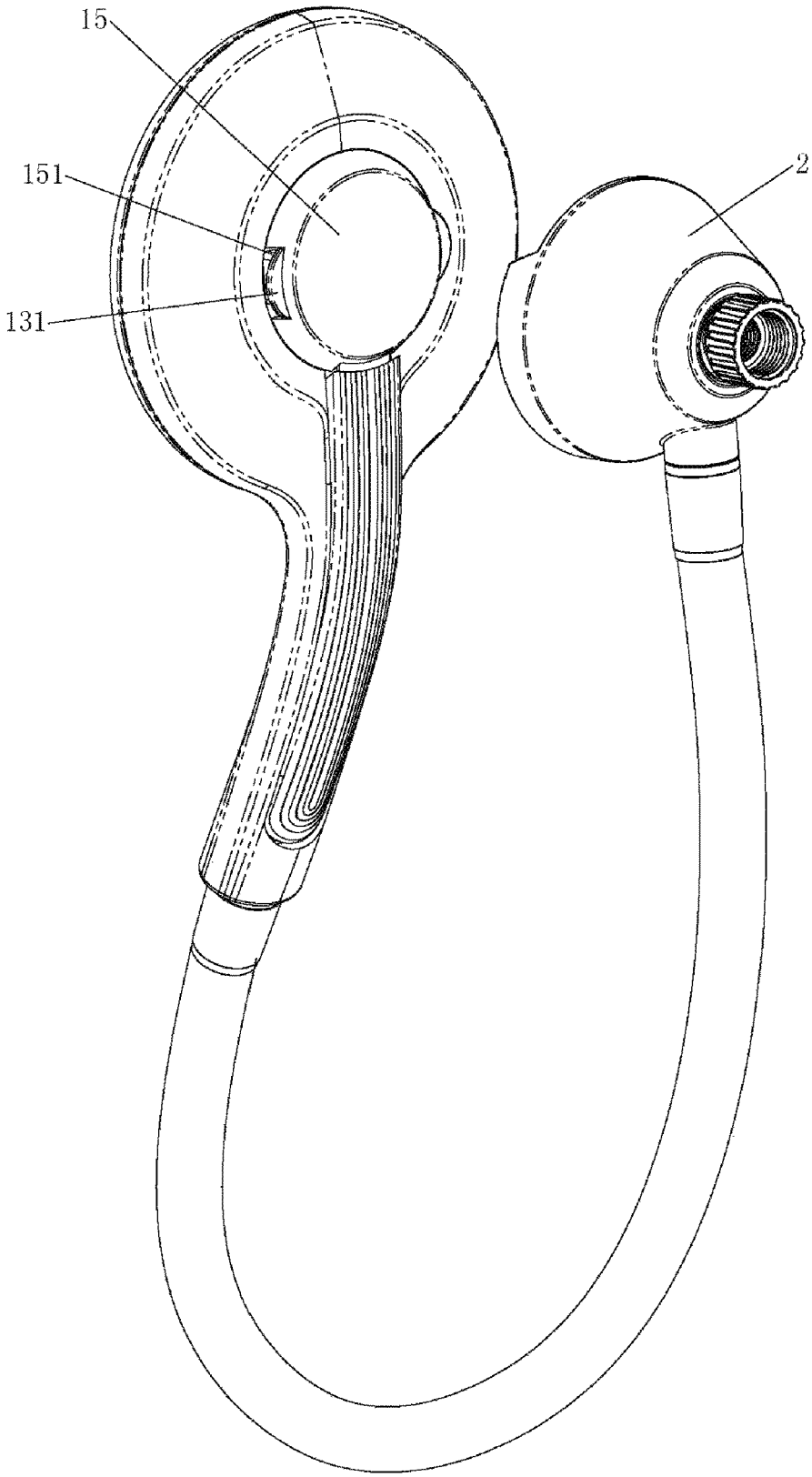
FIG. 7 is a second schematic perspective view of the structure of the shower head holder structure in an embodiment of the present disclosure.
Figure 8:
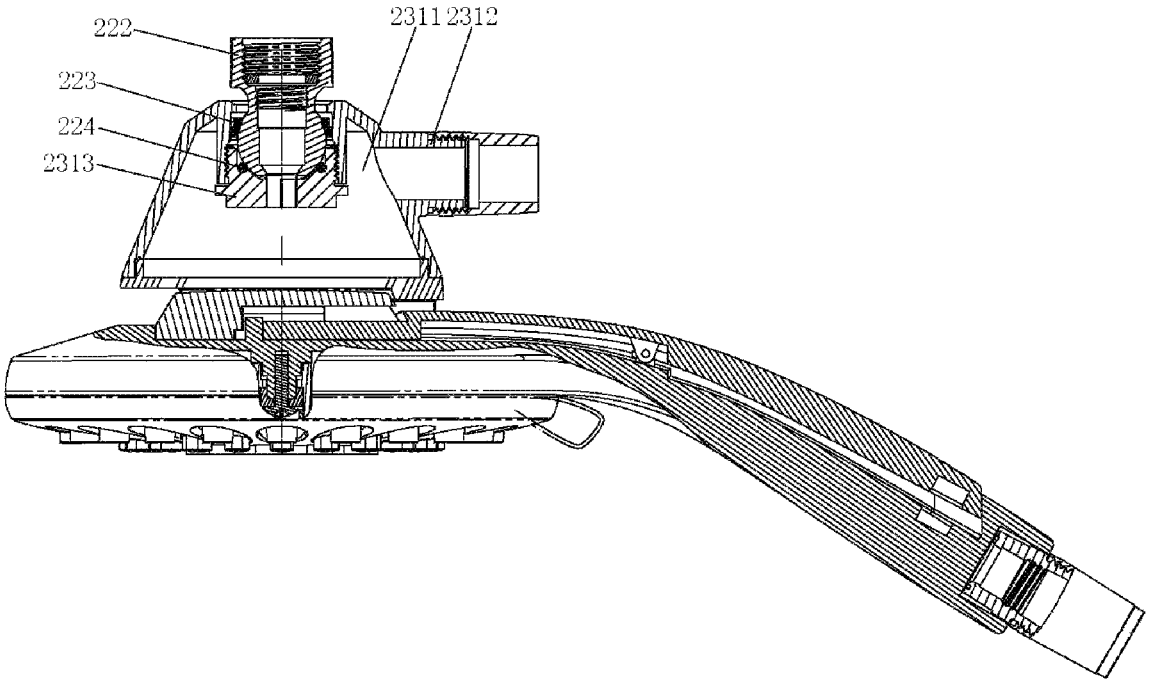
FIG. 8 is a schematic cross-sectional view of the structure of the holder in the embodiment of the present disclosure.

Referring to FIG. 1 to FIG. 8, FIG. 1 to FIG. 8 are schematic views showing the shower head holder structure in the embodiment. In an embodiment, the holder structure of shower head 1 includes a shower head 1 and a holder 2.

Specifically, the shower head 1 has a lever 11, a first elastic member 12, a pair of blocks 13, a pair of second elastic members 14, a convex cover 15, a groove 16 and an abutting sheet 17.

The fulcrum of the lever 11 is disposed on the back surface of the shower head 1, the first end 111 of the lever 11 extends to the handle of the shower head 1 for pressing, and the second end 112 thereof extends to the back of the nozzle of the shower head 1. The shape of the lever 11 in the longitudinal direction is integrally matched to the shape of the back surface of the shower head 1 to ensure the aesthetic sense of the overall shower head 1. It should be understood that the shower head 1 has a shower head body 18, the handle of shower head 1 and the nozzle of shower head 1 are the handle and the nozzle of the shower head body 18.

The first elastic member 12 is a spring, but does not exclude other elastic materials such as a soft colloid, an elastic pad and the like which have compressible and resilient properties. The first elastic member 12 is disposed between the first end 111 of the lever 11 and the fulcrum, and both ends of the first elastic member 12 act on the back surface of the shower head 1 and the handle of the shower head 1. In order to improve the stability of the first elastic member 12 after assembly, both ends of the first elastic member 12 in the embodiment can be adhered to the handle of shower head 1 and the lever 11 respectively, or a corresponding positioning groove can be provided on the handle of shower head 1 and the lever 11 respectively for positioning and loading both ends of the first elastic member 12.

A pair of blocks 13 are respectively disposed on both sides of the second end 112 of the lever 11. Specifically, in the embodiment, the blocks 13 are slidably mounted on the back of the nozzle of shower head 1, and the surfaces of the two blocks 13 facing away from each other are both provided with an engaging protrusion 131 protruding outwardly from the blocks 13. Moreover, the surfaces of the two blocks 13 facing away from each other are provided with a positioning hole 132 that is configured for positioning and abutting against the second elastic member 14.

A pair of second elastic members 14 are all springs, but do not exclude other elastic materials such as soft colloid, elastic pads and the like which have compressible and resilient properties. The pair of second elastic members 14 are respectively disposed corresponding to the blocks 13 on both sides. Both ends of a single second elastic member 14 respectively abut against the nozzle of the shower head 1 and the block 13. By means of the above structure, the following operation mode can be obtained: when the first end of the lever 11 is pressed, the first elastic member 12 is compressed, and the second end 112 of the lever 11 is lifted up. On this occasion, since the second end 112 of the lever 11 releases the abutment on the blocks 13 on both sides, the second elastic member 14 is elastically released such that the two blocks 13 are brought closer to each other. When the first end 111 of the lever 11 is released, the first elastic member 12 is reset, the second end 112 of the lever 11 is driven to move downwards, and the blocks 13 on both sides are pushed again such that the two blocks 13 are away from each other and compress the second elastic member 14.

To allow the second end 112 of the lever 11 to be smoothly introduced between the two blocks 13 when the first end 111 of the lever 11 is released, in the embodiment, the two blocks 13 are respectively provided with guiding slopes on opposite sides of each other. In the meantime, the two side walls of the second end 112 of the lever 11 are symmetrical, and each side wall is distributed with a first wall 1121 and a second wall 1122 which are sequentially connected in thickness. The first wall 1121 is inclined corresponding to the guiding slope, and the side away from the second wall 1122 is configured to push the two blocks 13 on both sides away from each other. The second wall 1122 allows the two blocks 13 on both sides to abut against when the two blocks 13 on both sides close to each other, that is, when the two blocks 13 on both sides are brought closer to each other in position, they abut against the second wall 1122 of the lever 11. The configuration of the first wall 1121 enhances the effect of guiding engagement of the second end 112 of the lever 11 with the guiding slope; the configuration of the second wall 1122 allows a part of the second end 112 of the lever 11 to remain between the two blocks 13 on both sides when the first end 111 of the lever 11 is pressed, which ensures that a certain space between the two blocks 13 can be kept while the two blocks 13 can be effectively moved out of the slots, such that the second end 112 of the lever 11 can be reliably inserted into the space between the two blocks 13 when the first end 111 of the lever 11 is released.

The convex cover 15 is a circular cover-shaped structure, which is detachably fixed on and covers the back of the nozzle of shower head 1. In the embodiment, the specific fixing manner is that a number of insertion rods 152 extending toward the back of the nozzle of the shower head 1 are formed at the bottom in the convex cover 15, and a number of insertion holes corresponding to each insertion rod 152 are formed on the back of the nozzle of the shower head 1. When the convex cover 15 covers the back of the nozzle of the shower head 1, the insertion rods 152 are inserted into the insertion holes and fixed to secure the convex cover 15 on the nozzle of the shower head 1. The fixing structure is simple and easy to assemble and disassemble, and is convenient for installation and maintenance. Specifically, the inner wall of the convex cover 15 and the back surface of the nozzle of the shower head 1 further define and form a sliding slot for the blocks 13 to slide so as to reliably guide the sliding movement of the blocks 13. Further, the side wall of the convex cover 15 is further provided with a pair of notches 151 disposed opposite to each other. The notches 151 are disposed corresponding to the blocks 13 for the engaging protrusions 131 on the blocks 13 to pass through; the second end 112 of the lever 11 is disposed in the convex cover 15. Accordingly, the side wall of the convex cover 15 should also be provided with a notch 151 for the lever 11 to pass through.

In this embodiment, the convex cover 15 is disposed to form a hanging portion, and the hanging portion is configured to further form a hanging relationship with the holder 2 to improve the stability of the shower head 1 when it is hung on the holder 2.

In this embodiment, the back surface of the shower head 1 is provided with a groove 16 extending from the handle of the shower head 1 to the nozzle of shower head 1. The groove 16 is configured for positioning and installing the lever 11 and the convex cover 15 therein. It can be obtained that the shape of the groove 16 should match the shape of the lever 11 and the convex cover 15; the inner wall of the convex cover 15 cooperates with the bottom of the groove 16 to define and form the required sliding slot mentioned above.

The abutting sheet 17 is vertically fixed to the bottom of the groove 16, and is disposed corresponding to and spaced apart by the blocks 13 on both sides for the second elastic member 14 to abut against. Preferably, one side of the abutting sheet 17 facing the blocks 13 is provided with a blind hole for positioning, inserting and abutting the second elastic member 14, thereby further enhancing the stability of the second elastic member 14.

In the specific assembly process of the shower head 1 of the present embodiment, the first elastic member 12 is first loaded into the corresponding position of the handle of the shower head 1, and then the fulcrum of the lever 11 is rotatably connected to the back of the handle of the shower head 1. Next, the pair of second elastic members 14 are respectively inserted into the positioning holes 132 on both sides of the blocks 13, and then the two blocks 13 are assembled between the abutting sheet 17 and the lever 11. Thereafter, the notch 151 of the convex cover 15 is aligned with blocks 13 and the lever 11, and the insertion rods 152 thereon are aligned with and inserted into the insertion holes on the back of the shower head 1.

The holder 2 is secured on the wall surface for the shower head 1 to be slidably disposed thereon. Specifically, the holder 2 is provided with a pair of slots 2321 matching with the pair of blocks 13, and the function of hanging the shower head 1 on the holder 2 can be achieved when the blocks 13 extend into and engage with the pair of slots 2321.

Specifically, the holder 2 includes a bracket 21, a ball head assembly 22, and a hanger 23.

In detail, the bracket 21 is a rod-shaped structure, and the front end thereof is inclined downwardly toward the side where the user is located, and a first water passage is provided in the bracket 21 for communicating with the external water source.

The ball head assembly 22 includes a ball head cover 221, a ball head 222, a ball head sleeve 223 and a sealing ring 224. The water inlet end of the ball head 222 is sealingly and threadedly connected with one end of the bracket 21 away from the wall surface. The ball head cover 221 is sleeved on the outer periphery of the water inlet end of the ball head 222. The ball head end of the ball head 222 is sleeved in the hanger 23 and positioned in the hanger 23. A second water passage communicating with the first water passage is formed in the ball head 222. The ball head sleeve 223 and the sealing ring 224 are sleeved on both sides of the ball head end of the ball head 222 to form a hermetic cooperation with the inner wall of the hanger 23.

The hanger 23 has a cone-like structure, and the small end thereof is configured for assembling with the ball head assembly 22. The end surface of the large end is provided with the pair of slots 2321 matching with the blocks 13 on both sides. When the engaging protrusions 131 on the blocks 13 protrude through the notches 151 on both sides of the convex cover 15 and are engaged into the pair of slots 2321, the shower head 1 is hung on the holder 2, and when the engaging protrusions 131 on the blocks 13 are disengaged from the pair of slots 2321, the shower head 1 is detached from the holder 2. It can be seen from the structure that while the shower head 1 is hung on the holder 2, when the first end of the lever 11 is pressed to release the elastic force of the second elastic member 14 and the two blocks 13 are brought closer to each other under the elastic force of the second elastic member 14, the engaging protrusions 131 on the blocks 13 are disengaged from the pair of slots 2321, on this occasion, the shower head 1 can be easily removed from the holder 2. When the shower head 1 needs to be hung up on the holder 2, the first end of the lever 11 is pressed and the back of the nozzle of shower head 1 is brought closer to a corresponding hanging position of the holder 2, and then release the first end of the lever 11. On this occasion, the two blocks 13 are away from each other, and the engaging protrusions 131 thereon extend into the pair of slots 2321 again such that the shower head 1 is hung up on the holder 2. The operation can be performed simply by one hand. The lever 11 is located on the back of the shower head 1 and can be operated through four fingers, which is more labor-saving and convenient for the elderly and children to operate. The overall structure realizes the effect of easily picking up and placing the shower head 1, and the user experience can be significantly enhanced.

In the embodiment, the hanger 23 includes a base 231 and a surface cover 232. The base 231 is a cone-shaped structure, and is provided with a water inlet passage 2311 and a threaded joint 2313 therein. The threaded joint 2313 has an external thread and is screwed into the hanger 23 to abut against the ball head end of the ball head 222, and thus the position of the ball head 22 is limited. The threaded joint 2313 is provided with a fourth water passage therein, and the fourth water passage constitutes a part of the water inlet passage 2311 and communicates with the second water passage of the ball head 222. The ball head end of the ball head 222 is sealingly abutted against the inner wall of the base 231 and the threaded joint 2313 through the ball head sleeve 223 and the sealing ring 224. The side wall of the base 231 is provided with the connector 2312. The connector 2312 faces downward and has an external thread for assembling with the water inlet hose of the shower head 1. The connector 2312 is provided with a third water passage communicating with the water inlet passage 2311. By means of disposing the water inlet passage 2311 in the hanger 23, it is possible to obtain a multi-functional hanger. In the meantime, the height of the water inlet end of the shower head 1 is set higher, the water flow is smoother during use, and when the shower head is hung up, the pipeline will not form a large span on the wall surface, and a better aesthetic sense of the wall surface can be achieved.

The surface cover 232 is securely disposed on the large end of the base 231, and the pair of slots 2321 are formed on the outer surface of the surface cover. Specifically, the outer surface of the surface cover 232 is provided with a U-shaped hanging slot 2322, the size of the hanging slot 2322 matches with the size of the convex cover 15 for the convex cover 15 to be hung up thereon. In this manner, when the convex cover 15 is hung up on the holder 2, the lower end of the convex cover 15 has the hanging slot 2322 to provide support, thereby further enhancing the strength and stability of the shower head 1 when being hung up. Still, the structure does not require moving the shower head 1 upward or downward to pick up and place the same, and is easy to use with good strength. In this embodiment, the pair of slots 2321 are formed on both sides of the hanging slot 2322, and the opening of the pair of slots 2321 is disposed on the side wall of the hanging slot 2322, and the lower end of the hanging slot 2322 is formed with a recess 2323 for the lever 11 to pass through.

Picking up the shower head 1 from and hanging the shower head 1 on the holder 2 is realized by the following operation modes:

When the shower head 1 needs to be removed from the holder 2, the handle of the shower head 1 is held by hand, and the first end 111 of the lever 11 is pressed with four fingers. On this occasion, the second end 112 of the lever 11 is lifted, and the second elastic members 14 release the elastic force and the two blocks 13 are brought closer to each other under the elastic force until they abut against the second wall 1122 of the second end 112 of the lever 11. When the two blocks 13 are in close proximity to each other, the engaging protrusions 131 are disengaged from the pair of slots 2321, and the shower head 1 can be separated and removed from the holder 2. When the shower head 1 needs to be hung up on the holder 2, the first end 111 of the lever 11 is pressed again such that the two engaging protrusions 131 are retracted into the convex cover 15. Thereafter, the convex cover 15 on the nozzle of shower head 1 is attached to the hanging slot 2322 in position, the first end of the lever 11 is then released, the first elastic member 12 is reset, and the second end 112 of the lever 11 is driven to move downwards. Then, the two blocks 13 are away from each other, and the engaging protrusions 131 on both sides penetrate through the convex cover 15 again and extend into the pair of slots 2321 on both sides to realize the engagement.

As can be seen from the above description, in the shower head holder structure, the pressing end of the lever 11 is disposed on the handle of the shower head, and the pressing or releasing operation thereof is associated with the movement of the blocks 13 at the nozzle of the shower head, thereby realizing engagement or detachment of the blocks 13 and the pair of slots 2321, and the operation can be performed simply by one hand. The lever 11 is disposed on the back of the shower head, and the operation is more labor-saving by use of four fingers, and the operation is convenient for the elderly and children to perform. The overall structure realizes the effect of easily picking up and placing the shower head 1, thereby significantly enhancing the user experience. In the meantime, since the nozzle of shower head is hung up on the holder, the structural stability is better than that of conventional methods in which the soft hose connector is hung on the bracket, so it is possible to prevent the shower head from falling and hurting people. By adopting the technical solution with cooperation of the hanging portion and the hanging slot 2322, the lower end of the U-shaped hanging slot 2322 can support the hanging portion, and thus the stability of the shower head 1 can be improved when being hung up on the holder 2. Still, the structure does not require moving the shower head 1 upward or downward to pick up and place the same, the structure is easy to use with good strength. In addition, the configuration of the hanging slot 2322 and the recess 2323 at the lower end of the hanging slot 2322 can position the hanging configuration of the shower head; when the shower head is to be hung up, the blocks and the slots can be aligned with each other without adjusting the position for a plurality of times, and thus the hanging action can be performed more easily.

The above description in the specification and the embodiments are intended to explain the scope of the present disclosure, but do not constitute a limitation to the scope of the present disclosure.

What is claimed is:

1. A shower head holder structure, characterized in comprising:

a shower head provided with a lever, a first elastic member, a pair of blocks and a pair of second elastic members; wherein a fulcrum of the lever is disposed on the back of the shower head, and a first end of the lever extends to a handle of the shower head for pressing, a second end of the lever extends to the back of a nozzle of the shower head; the first elastic member is disposed between the first end of the lever and the fulcrum; the pair of blocks are respectively disposed on both sides of the second end of the lever; the pair of second elastic members are disposed corresponding to the pair of blocks; when the first end of the lever is pressed, the first elastic member is compressed, the second end is lifted, and the pair of second elastic members release an elastic force to bring the two blocks closer to each other; when the first end of the lever is released, the first elastic member is reset, and the second end is driven to move downwards, such that the two blocks are away from each other and compress the pair of second elastic members;

a holder having a pair of slots matched with the pair of the blocks thereon; when the pair of blocks extend into the pair of slots, the shower head is hung up on the holder.

2. The shower head holder structure according to claim 1, wherein when the first end of the lever is released, the shape of the lever matches the shape of the back of the shower head.

3. The shower head holder structure according to claim 1, wherein the pair of blocks are respectively provided with guiding slopes on opposite sides of each other to introduce the second end of the lever therebetween.

4. The shower head holder structure according to claim 3, wherein two side walls of the second end of the lever are symmetrical, and each side wall is distributed with a first wall and a second wall which are sequentially connected in thickness; the first wall is inclined corresponding to the guiding slope, and one side away from the second wall is configured to push the pair of blocks on both sides away from each other; the second wall allows the pair of blocks on both sides to abut against while the pair of blocks moving towards each other.

5. The shower head holder structure according to claim 1, wherein the back of the nozzle of the shower head is provided with a hanging portion; and the pair of blocks and the second end of the lever are disposed in the hanging portion, and sides of the pair of blocks away from each other are both provided with engaging protrusions protruding through an outer wall of the hanging portion and cooperating with the pair of slots;

the holder is provided with a hanging slot for hanging the hanging portion; the hanging slot has a U-shaped structure, a lower end thereof is provided with a recess for the lever to pass through, and a side wall of the hanging slot is provided with an opening of the pair of slots.

6. The shower head holder structure according to claim 5, wherein the shower head comprises a convex cover; the convex cover is detachably fixed on a back surface of the shower head, and constitutes the hanging portion.

7. The shower head holder structure according to claim 6, wherein the back surface of the shower head is provided with a groove for positioning and installing the lever and the convex cover; a wall of the groove matches an inner wall of the convex cover to define and form a sliding slot for the pair of blocks to slide.

8. The shower head holder structure according to claim 1, wherein one side of the pair of blocks for abutting against the second elastic member is provided with a positioning hole for positioning and placing the second elastic member.

9. The shower head holder structure according to claim 1, wherein the holder comprises:

a bracket that is fixed on a wall;

a ball head assembly attached to one end of the bracket away from the wall;

a hanger attached to the ball head assembly and provided with the pair of slots.

10. The shower head holder structure according to claim 9, wherein the hanger is provided with a water inlet passage therein communicating with an external water source, and a connector is disposed at a lower end of the hanger; the connector communicates with the water inlet passage and is configured for assembling with a water inlet hose of the shower head.

* * * * *